US005109954A

United States Patent [19]

Skyba

[11] Patent Number: 5,109,954

[45] Date of Patent: May 5, 1992

[54] WEIGHT BEARING APPARATUS FOR HANGING ON UPRIGHT STRUCTURES

[76] Inventor: Helmut K. Skyba, Route 2, Box 330, Wild Rose, Wis. 54984

[21] Appl. No.: 619,940

[22] Filed: Nov. 29, 1990

[51] Int. Cl.[5] ..... E06C 7/48; E06C 1/34

[52] U.S. Cl. ..... 182/189; 182/100; 182/206

[58] Field of Search ..... 182/206, 100, 189

[56] References Cited

U.S. PATENT DOCUMENTS

| | | | |
|---|---|---|---|
| 985,349 | 2/1911 | Rosenfelder | 182/206 |
| 1,142,072 | 6/1915 | Wingerd | 182/206 |
| 1,961,289 | 6/1934 | Gardner | 182/206 |
| 3,028,929 | 4/1962 | Chubbs | 182/206 |
| 3,995,714 | 12/1976 | Brookes | 182/206 |
| 4,018,301 | 4/1977 | Nameche | 182/206 |
| 4,467,890 | 8/1984 | McCallum | 182/206 |
| 4,946,004 | 8/1990 | Henson | 182/206 |

*Primary Examiner*—Reinaldo P. Machado
*Attorney, Agent, or Firm*—Fuller, Ryan & Hohenfeldt

[57] ABSTRACT

An improved apparatus supports weight on an upright structure. The apparatus has a frame with a weight bearing surface and a mechanism attached to the frame that grips the structure to hang the frame on the structure free of contact with the ground. The gripping mechanism can be easily attached to and removed from the structure by the user from a position on the ground. The force that gripping mechanism exerts to hold the frame in place upon the structure is directly proportional to the weight borne by the frame.

26 Claims, 7 Drawing Sheets

FIG. 3
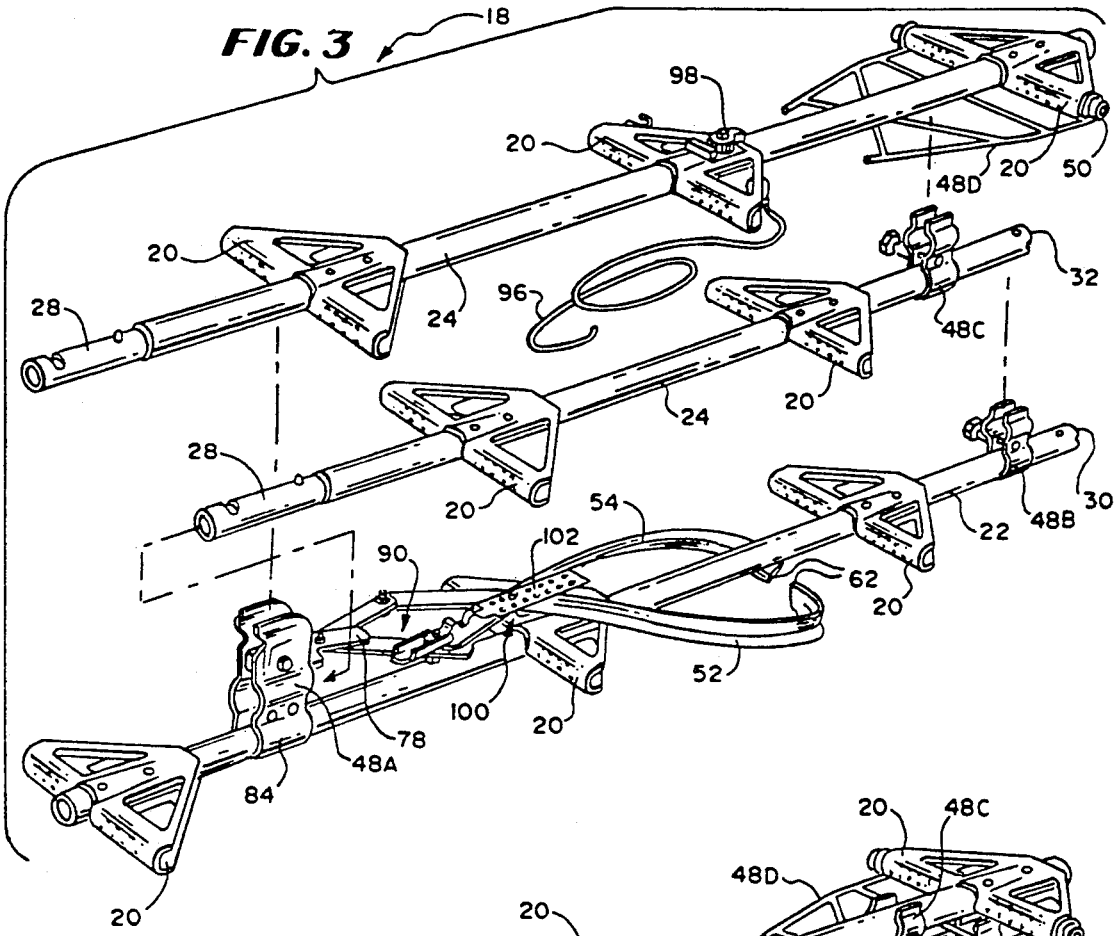
FIG. 3A
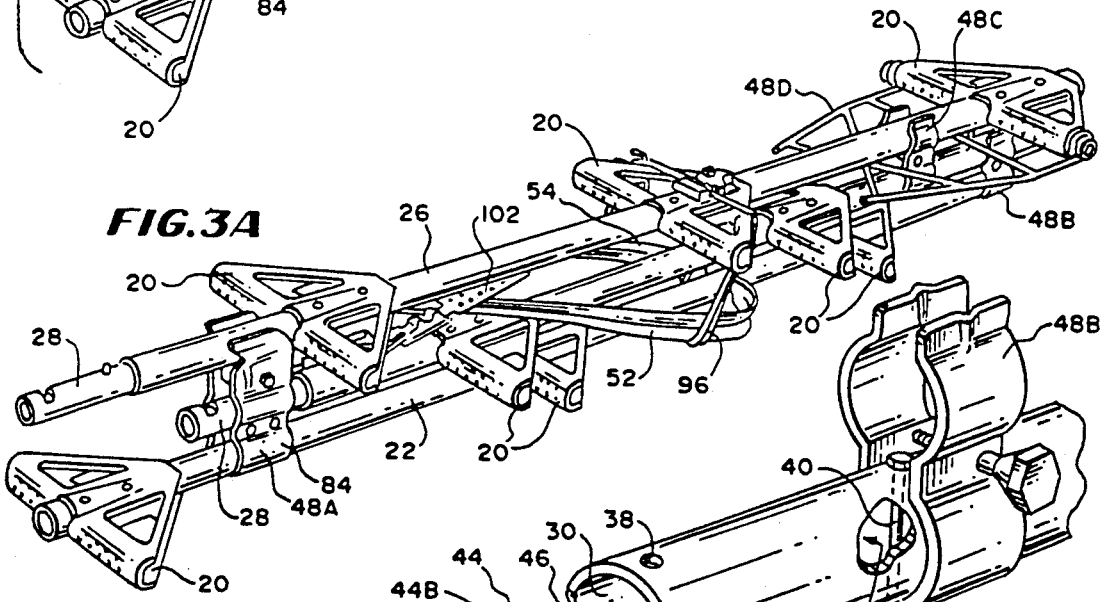
FIG. 4

WEIGHT BEARING APPARATUS FOR HANGING ON UPRIGHT STRUCTURES

FIELD OF THE INVENTION

The invention relates to apparatus for bearing a weight free of contact with the ground. In a more particular sense, the invention relates to apparatus that can be hung upon an upright structure for gaining access or bearing weight upon the structure.

BACKGROUND OF THE INVENTION

Apparatus for gaining access to the upper reaches of tall, upstanding structures are well known. One example that comes readily to mind is a ladder. As typically used, one end of the ladder rests on the ground, while the other end rests against the structure intended to be climbed.

There are many situations were a conventional ladder is not well suited for use. For example, by spanning the distance between the ground and the structure, ladders are inherently subject to falling due to high winds or by movement or swaying of the structure itself. Furthermore, ladders are often awkward to set up and to take down, particularly by a single user. The tasks of setting up and taking down are made even more difficult in close or crowded quarters like wooded areas. There, branches, brush or limbs can obstruct the path through which the ladder must be swung into position. Furthermore, establishing the ladder on rocky or uneven ground, or in areas where the firmness of the soil varies, can present real stability problems.

It is an object of this invention to provide an improved apparatus for supporting weight on an upright structure that can be secured to the structure in use in a manner that is free of contact with the ground.

It is another object of this invention to provide an improved apparatus for supporting weight on an upright structure that can be easily secured to the structure prior to use, and that can just as easily be removed from the structure after use.

Still another object of the invention is to provide an improved apparatus having all the benefits just described, and that in additional can be easily transported, set up, and taken down by a single person standing on the ground.

Yet another object of this invention is to provide a weight supporting apparatus that can be transported and safely used in the wild by hunters and naturalists.

SUMMARY OF THE INVENTION

The invention achieves these and other objects in providing an improved apparatus for supporting weight on an upright structure. The apparatus comprises a weight bearing frame having a gripping mechanism that securely fastens itself to the upright structure for supporting weight free of contact with the ground. The gripping mechanism that embodies the features of the invention can be easily attached to and removed from the structure by a single user from the ground. Also, according to the invention, the force that the gripping mechanism exerts in holding the frame on the structure during use is directly proportional to the weight borne by the frame itself. The gripping mechanism is therefore self-adjusting to the conditions imposed during use.

The gripping mechanism that embodies the features of the invention includes cooperating first and second gripping arms. Each gripping arm includes an outer end portion that extends beyond the frame. Each outer end portion is equipped with an edge that removably grips the surface.

A first linkage assembly joins the gripping arms for moving the outer end portions away from and toward each other. The first linkage assembly serves to open the gripping arms a sufficient distance apart to receive the structure between the gripping edges. The first linkage assembly also serves to close the gripping arms a sufficient distance together to engage the structure with the gripping edges.

A second linkage assembly joins the first linkage assembly to the frame. The second linkage assembly serves to open and close the gripping arms in response to forces applied by the user to move the frame relative to the structure. The second linkage assembly allows the user to remotely control the operation of the gripping arms from the ground to attach the frame to the structure before use; to solidly secure the frame to the structure during use; and to easily remove the frame from the structure after use.

Before use, the second linkage assembly attaches the frame to the structure when the gripping arms are opened a sufficient distance to receive the structure and contact at least one side edge of the received structure. In this mode of operation, the second linkage assembly serves, as the user further manipulates the frame into contact against the structure, to close the gripping arms a sufficient distance to also bring both gripping edges into contact with the structure.

During use, the second linkage assembly serves, in response to the force of the weight borne by the frame, to urge the gripping arms continuously toward each other. The continuous closing force exerted by the gripping arms as weight is applied to the frame secures a tight engagement of both the gripping edges to the structure in proportion to the weight that is applied.

After use, the second linkage assembly opens the gripping arms a sufficient distance to release the structure in response to a force exerted by the user that moves the frame in a direction away from the ground.

In a preferred embodiment, each gripping arm is curved lengthwise toward the ground. The curved shape directs the forces that are applied to the gripping arms during use in a path that generally extends along the vertical axis of the structure. The curved shape thereby prevents the applied forces from dragging or pulling the gripping arms loose across the vertical axis of the structure.

Also in a preferred embodiment, each the gripping arms is beveled across its width into a generally V-shape configuration, with the base of the V generally facing the side of the structure being engaged by the gripping edge. This configuration places the side edges of the gripping arms away from the structure. It also creates a zone of reduced surface area in the region of the gripping arms that extends between the frame and the gripping edge. This configuration minimizes the chance that regions of the gripping arms between the frame and the gripping edges will wedge against the exterior surface of the structure. This configuration is particularly beneficial when the exterior surface of the structure is rough or has uneven protrusions.

In another preferred embodiment, the gripping mechanism includes stops to limit the distance that the gripping arms can be opened or closed. The stops prevent binding or damage to the gripping arms by over and under extension of the first and second linkage assemblies.

In a most preferred embodiment, the apparatus takes the form of a hanging ladder for climbing a tree.

Other features and advantages of the invention will be pointed out in, or will become apparent from, the drawings, specification and claims that follow.

DESCRIPTION OF THE DRAWINGS

FIG. 3 is an exploded front elevation of the three frame sections shown in FIG. 2 horizontally oriented for joining in a transport position;

FIG. 3A is a front elevation view of the three frame sections shown in FIG. 2 joined in a horizontally oriented transport position;

FIGS. 4 to 6 are an enlarged perspective view of the sequence of joining together the ends of two frame sections shown in FIG. 2;

Figure 1:
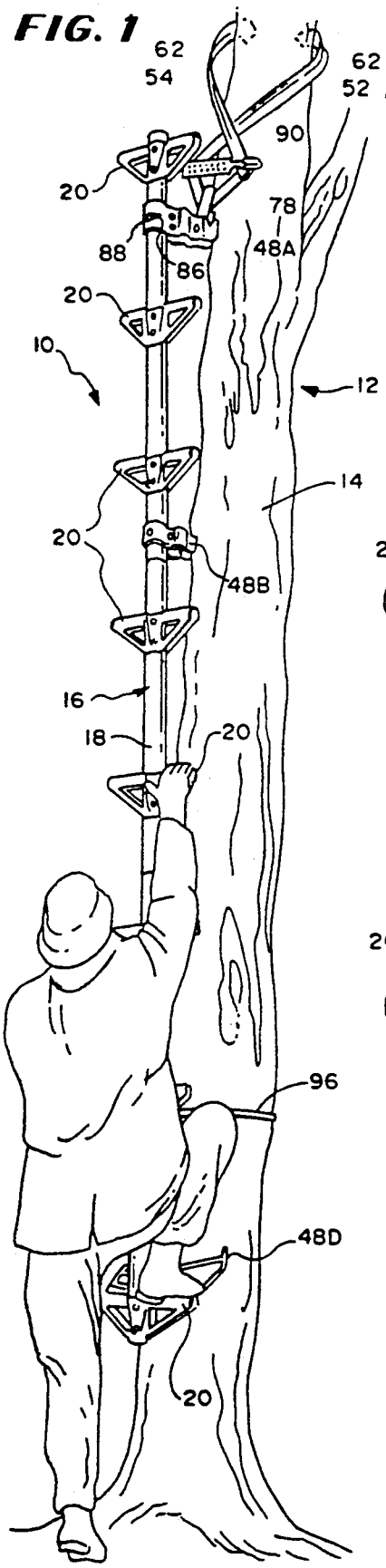
FIG. 1 is a perspective front elevation view of a hanging ladder that embodies the features of the invention and that is shown in use on a tree.

The invention is not limited to the details of the construction and the arrangements of parts set forth in the following description or shown in the drawings. The invention can be practiced in other embodiments and in various other ways. The terminology and phrases are used for description and should not be regarded as limiting.

DESCRIPTION OF THE PREFERRED EMBODIMENTS

FIG. 1 shows an apparatus 10 that embodies the features of the invention. In use, the apparatus 10 is attachable to an upright structure 12 having opposite, generally vertical side edges. As FIG. 1 shows, the attached apparatus 10 hangs on the structure 12, free of contact with the ground. Once attached, the apparatus 10 supports weight to allow the user to climb or otherwise access the above-ground regions of the structure 12. After use, the apparatus 10 can be detached from the structure 12 for transport by the user to another site in the compact configuration shown in FIG. 3A.

As used in this Specification, the term "up-right structure" refers to a structure that extends vertically above the ground, with a height (its vertical dimension) that is significantly greater than its width or girth (its horizontal dimension). Generally speaking, the apparatus 10 can be used in any environment that requires temporary access to the upper regions of the structure 12 that cannot be easily reached from the ground. Flag poles, light poles, telephone poles, sign posts, and trees are all examples of upright structures with which the invention can be used.

In the illustrated embodiment, the structure 12 is a tree 14. In this environment, the apparatus 10 takes the form of a hanging ladder 16 that allows an individual to climb the tree 14. In particular, the illustrated embodiment contemplates the use of the hanging ladder 16 by a hunter or naturalist who seeks to temporarily attach a tree 14 stand or viewing platform to the tree 14. As described in this Specification, the hanging ladder 16 has many features that beneficially adapts it to this particular use. Still, the invention is not to be limited to use in this particular environment.

As FIG. 1 shows, the ladder 16 includes a frame 18 having at least one weight bearing surface 20. In the illustrated embodiment, there are several weight bearing surfaces 20, vertically stacked one above the other, that constitute the rungs or steps of the ladder 16.

The frame 18 may be constructed in various ways and out of different materials. In the illustrated embodiment, portability by a single individual is a desirable feature. Also, in the illustrated embodiment, the frame 18 is intended to support the weight of the single individual and his or her hunting equipment. In this context, the frame 18 is made of relatively lightweight tubular metal stock having an outer diameter of about 1.5 to 2.0 inches. Of course, the frame 18 could be made of heavier, more sturdy materials in work environments where greater durability or greater weight handling capacities are required. Metal stock of aluminum or steel can be used. Alternatively, the frame 18 can be made of sturdy nonmetal material, like fiberglass.

In the illustrated embodiment, the weight bearing steps 20 of the ladder 16 are made from metal sheet stock formed into the desired shape. The top surface of each rung 20 is studded for sure footing. The rungs 20 are joined to the tubular frame 18 by structural rivets. Of course, welding or other fasteners could be used for this purpose.

Figure 2:
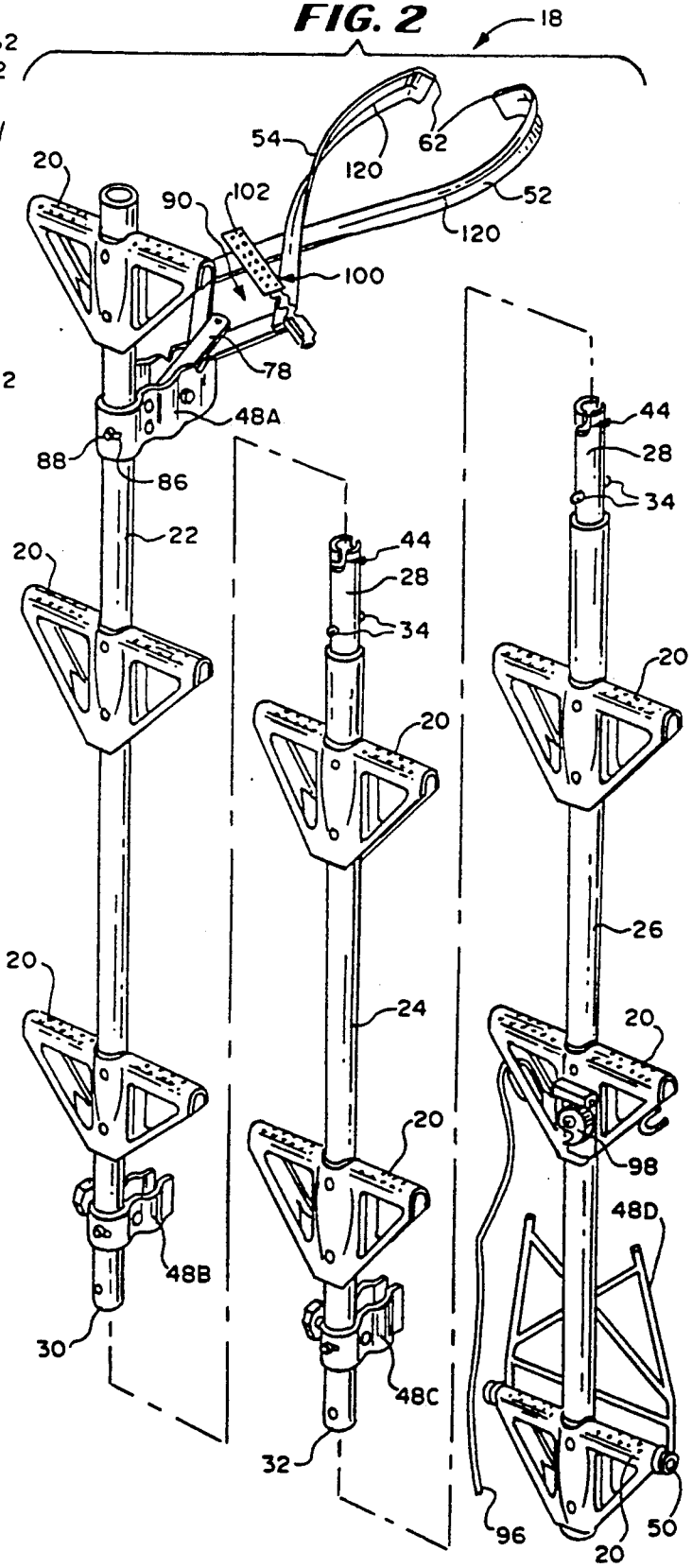
FIG. 2 is an exploded front elevation view of the ladder shown in FIG. 1 disassembled into three frame sections prior to use.

As FIG. 2 shows, in the illustrated embodiment, the ladder frame 18 breaks apart into three sections: a top section 22, a middle section 24, and a bottom section 26. Of course, the number of sections can be less than or more than the three sections shown in the illustrated embodiment, depending upon the final set-up height desired.

In use, the sections 22, 24, and 26 are coupled by the user on site into the vertically stacked relationship shown in FIG. 1. After use, the three sections 22, 24, and 26 can be uncoupled (as FIG. 2 shows) and arranged on site in a horizontally stacked relationship (as FIGS. 3 and 3A show) for transport. Further details of joining the sections 22, 24, and 26 into this vertically stacked relationship will be described later.

In the illustrated embodiment, when broken down for the transport in the relationship shown in FIG. 3A, the three-part frame 18 has a maximum length of about four feet. It weighs about eleven pounds.

The user can easily set up the ladder 16 on site. The middle and bottom frame sections 24 and 26 each include a joiner collar 28 of reduced overall diameter than the frame stock. In the illustrated embodiment, the joiner collar 28 is about ¼ inch less in overall diameter than the frame stock.

As FIG. 2 shows, the joiner collar 28 of the middle section 24 can be inserted telescopically into the bottom end 30 of the top section 22. The joiner collar 28 of the bottom section 26 can then be inserted telescopically into the bottom end 32 of the middle section 24 to complete the frame assembly. In the illustrated embodiment, the completed frame 18 has a vertical height of about eleven feet. Further details of this set up sequence will be described later.

Figure 5:
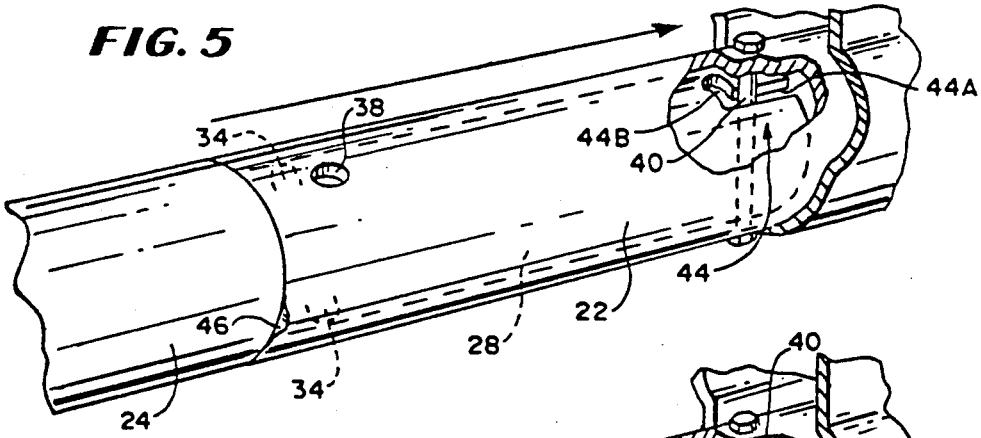
Figure 6:
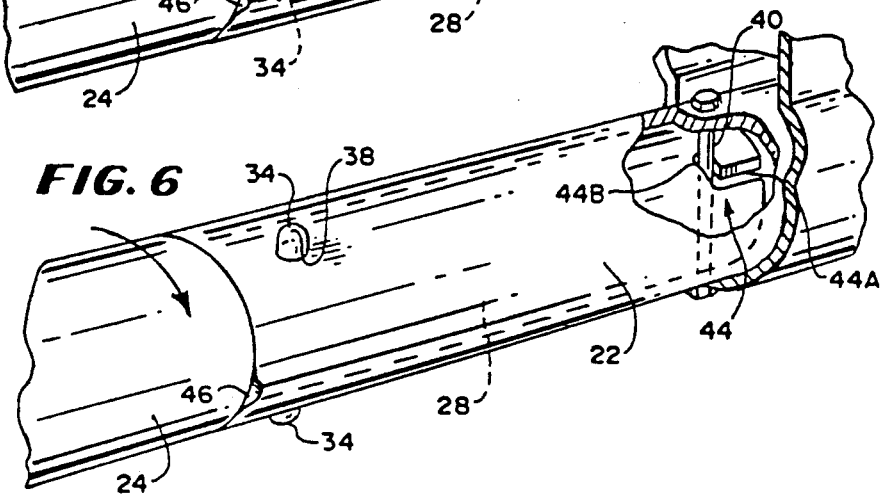

In the illustrated and preferred embodiment (as FIGS. 4 to 6 show), each joiner collar 28 includes a pair of locking pins 34. The locking pins 34 are biased by an interior spring 36 toward a normally extended position (shown in FIG. 4). As FIG. 5 shows, the locking pins 34 can be pressed in by the user against the biasing force into a retracted position, flush with the outer surface of the collar 28. This allows the joiner collar 28 to be inserted into the mating end 30 or 32 of the associated frame section 22 or 24, respectively. The associated mating end 30 or 32 includes a pair of apertures 38 that register with the locking pins 34 when the two frame sections are properly joined and aligned. Upon registration with the apertures 38, the locking pins 34 spring back to their normally extended position within the apertures 38 (as FIG. 6 shows). The interference between the pins 34 and the apertures 38 locks the mating frame sections together.

Still referring to FIGS. 4 to 6, in the illustrated and preferred embodiment, the mating end 30 and 32 of each frame section 22 and 24 also includes an interior locking bar 40 that extends across the bore 42 of the tubular frame section. The mating joiner collar 28 includes opposite L-shaped slots 44. The section 44A of each slot that is aligned with the axis of the frame receives the locking bar 40 when inserted into the mating end in the desired set up orientation. The set up orientation in the illustrated embodiment (see FIG. 5) is about forty-five degrees from the final orientation (see FIG. 6).

The proper set up orientation is marked for the user by alignment guides 46 on the end of the mating frame section. The alignment guides 46 register with the locking pins 34 when the frame sections are in the prescribed set up orientation.

Once in the set up orientation, the user slides the joiner collar 28 into the mating section end 30 or 32 to insert the locking bar 40 within the slot section 44A (see FIG. 5). The user next rotates the joined assembly from the set up orientation into the final orientation. The rotation moves the locking bar 40 into the other, transverse section 44B of each slot (see FIG. 6). At the same time, the locking pins 34 register and spring back into the apertures 38.

The interference between the bar 40 and the slot section 44B, like the interference between the locking pins 34 and apertures 38, prevents separation of the mating frame sections during use. When break down is required, the user follows the reverse sequence of steps.

The above described arrangement assures fast and efficient set up and break down of the hanging ladder 16 at a remote site. It also assures proper structural strength and safety when attached to the structure 12.

Each frame section 22, 24, and 26 includes at least one standoff bracket 48. The standoff brackets 48 hold the frame a fixed distance away from the tree 14, enabling the user's feet to extend into the space when climbing. In the illustrated embodiment, the top frame section 22 has two standoff brackets 48, one 48A at the top portion and the other 48B located at the lower portion of the frame section 22. The middle frame section 24 and the bottom frame section 26 each have one standoff bracket 48C and 48D, respectively.

While various constructions are possible, in the illustrated embodiment, the standoff brackets 48A, 48B, and 48C associated with the top and middle frame sections 22 and 24 are formed from spaced apart sections of metal sheet stock.

The lowermost standoff bracket 48D of the bottom frame section 26 is pivotally connected by a bar 50 to the frame section 26 for vertical up and down movement. This standoff bracket 48D accommodates vertical movement of the assembled frame 18 upon the tree 14, as weight is applied and removed from the assembled frame 18 during use (as will be described in greater detail later).

As FIG. 3A shows, the spaced apart standoff brackets 48A, 48B, and 48C of the top and middle frame sections 22 and 24 also serve to interconnect the frame sections together for transport in their horizontally stacked relationship.

The upper part of the assembled frame 18 (top frame section 22) includes first and second gripping arms 52 and 54 that embody the features of the invention. As will be described in greater detail, the gripping arms 52 and 54 allow the user to assemble the ladder 16 from the ground, one section at a time, prior to use. After assembly, the gripping arms 52 and 54 also securely lock the assembled ladder 16 onto the tree 14. The ladder 16 functions as a secure, weight supporting hanging structure free of contact with the ground. After use, the gripping arms 52 and 54 allow the ladder 16 to be quickly disassembled by the user from the ground, one section at a time, and removed from the tree 14.

To achieve these and other objects (see FIGS. 1, 7 and 8), each gripping arm 52 and 54 has an inner end portion 56 attached next to the frame 18 and an outer end portion 58 that extends beyond the frame 18 and into contact with the sides of the tree 14. Each outer end portion 58 has opposite ,side edges 60 and an end edge 62 that, in use, grips the tree 14.

In the illustrated embodiment, the gripping end edge 62 is sharped to bite into the surface of the tree 14, thereby securing the associated gripping arm 52 or 54. Other gripping arrangements can be used, according to the particular characteristics of the associated structure 12.

Figure 7:
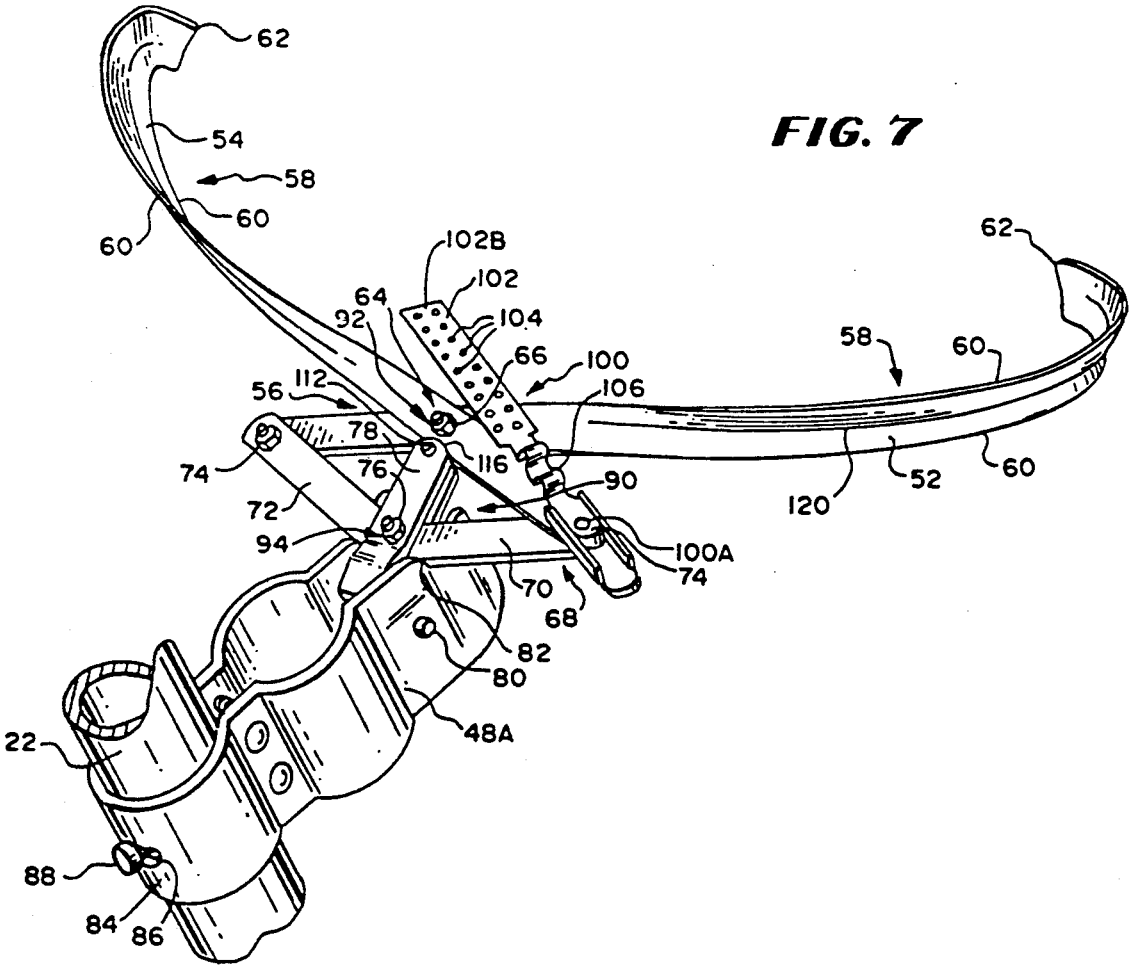
FIG. 7 is a top plan view of the gripping arms associated with the hanging ladder shown in FIG. 1 in their fully opened position.
Figures 8, 9:
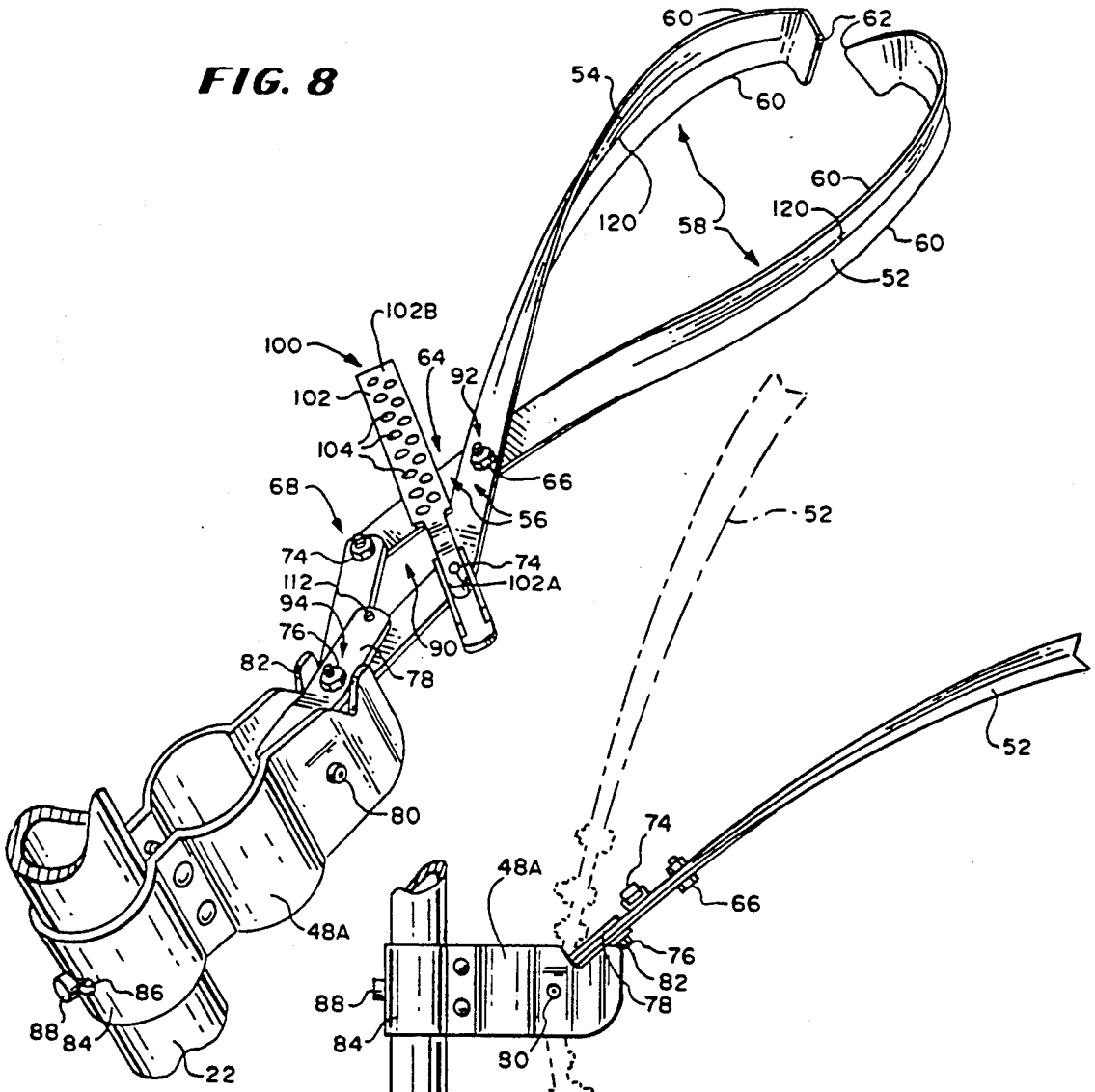
FIG. 8 is a top plan view of the gripping arms associated with the hanging ladder shown in FIG. 1 in their fully closed position.
FIG. 9 is a side view of the gripping arms associated with the hanging ladder shown in FIG. 1, showing their capacity for vertical up and down movement relative to the frame of the ladder.

A first linkage mechanism 64 joins the gripping arms 52 and 54 together. As FIGS. 7 and 8 show, the first linkage mechanism 64 moves the outer end portions 58 of the gripping arms 52 and 54 mutually away from and mutually toward each other in response to applied force. The first linkage mechanism 64 thereby either opens the distance between the outer end portions 58

(see FIG. 7) or closes the distance between the outer end portions 58 (see FIG. 8).

The particular dimensions of the gripping arms 52 and 54 and the operation of the associated first linkage mechanism 64 can of course vary with the requirements of the intended field of use. When used in association with the hanging ladder 16, each gripping arm 52 and 54 is formed of a length of heat treated spring steel. Each gripping arm 52 and 54 measures about two feet from its inner end portion 56 to its outer end portion 58.

In the illustrated embodiment, the first linkage mechanism 64 takes the form of a fastener that pivotally joins the inner end portions 56 of the arms 52 and 54 together in a scissors-like relationship. The fastener can be variously constructed. In the illustrated embodiment, the fastener is a threaded bolt and nut 66 that passes through overlapping holes bored in the arms 52 and 54.

The scissors-like action of the first linkage mechanism 64 serves to open the outer end portions 58 of the gripping arms 52 and 54 a sufficient distance to receive the side edges of an average tree 14 between the gripping edges 62. This distance can vary, but an open distance (as measured between the two outer end portions 58, as shown in FIG. 7) of about two feet is believed to be adequate for the use shown in FIG. 1.

In this arrangement, the scissors-like action of the first linkage mechanism 64 also serves to close the outer end portions 58 of the gripping arms 52 and 54 a sufficient distance to securely engage the side edges of a normal tree 14 with the gripping edges 62 (as FIG. 1 shows).

A second linkage mechanism 68 joins the first linkage mechanism 64 to the frame 18 (see FIGS. 1, 7, and 8). The second linkage mechanism 68 operates the first linkage mechanism 64 by transferring the forces applied by the user through the frame 18 directly to the first linkage mechanism 64. The second linkage mechanism 68 thereby serves to open and close the gripping arms 52 and 54 in response to forces remotely applied by the user between the frame 18 and the tree 14 from ground level.

In one mode of operation (shown in FIG. 11), the second linkage mechanism 68 enables the user to remotely operate the first linkage mechanism 64 to attach and assemble the frame 18 to the tree 14 while standing on the ground.

In another mode of operation (shown in FIG. 12), the second linkage mechanism 68 enables the user to remotely operate the first linkage mechanism 64 to secure the engagement of the gripping edges 62 on the tree 14 by using the frame 18 as a weight supporting structure.

In a third mode of operation (shown in FIG. 13), the second linkage mechanism 68 enables the user to remotely operate the first linkage mechanism 64 to disassemble and remove the frame 18 from the tree 14 while standing on the ground.

While various constructions can be used, in the illustrated embodiment (see FIGS. 7 and 8), the second linkage mechanism 68 includes two link bars 70 and 72. One end 70A/72A of each link bar is pivotally attached by a threaded bolt 74 to the inner end portion 56 of the associated gripping arm 52 or 54. The opposite ends 70B/72B of each link bar are commonly pivotally joined by a threaded bolt 76 to a carriage bracket 78.

The carriage bracket 78 is itself pivotally attached to the frame 18 by a threaded bolt 80 in the space between the upper standoff bracket 48A. As FIG. 9 shows, the carriage bracket 78 and the gripping arms 52 and 54 pivot as a unit up and down in the standoff bracket 48A and thus relative to the frame 18 itself.

The standoff bracket 48A to which the carriage bracket 78 is attached includes a limit surface 82. When the gripping arms 52 and 54 are opened, the limit surface 82 prevents downward pivotal movement of the assemblage of the carriage bracket 78 and gripping arms 52 and 54 below a predetermined point. The limit surface 82 in effect positions the gripping arms 52 and 54 at a predetermined angular relationship with the frame 18 to facilitate attachment to the tree 14 by a single user at ground level.

However, by lifting the gripping arms 52 and 54 above this limit surface 82 and then closing the gripping arms 52 and 54, the assemblage of the carriage bracket 78 and gripping arms 52 and 54 can be lowered as a unit through the spaced apart standoff bracket 48A into a transport position next to the frame 18 (shown in phantom lines in FIG. 9). The gripping arms 52 and 54 are lowered into this position after use for transport in the orientation shown in FIG. 3A.

In the illustrated and preferred embodiment (see FIG. 10), the standoff bracket 48A to which the carriage bracket 78 is attached is itself movably connected by a sleeve 84 to the frame 18. The sleeve 84 can be rotated on the frame 18 about the vertical frame axis, thereby moving the gripping arms 52 and 54 from side to side on the frame 18. A slot 86, through which a guide pin 88 attached to the frame 18 passes, limits the range of side to side movement.

Figure 10:
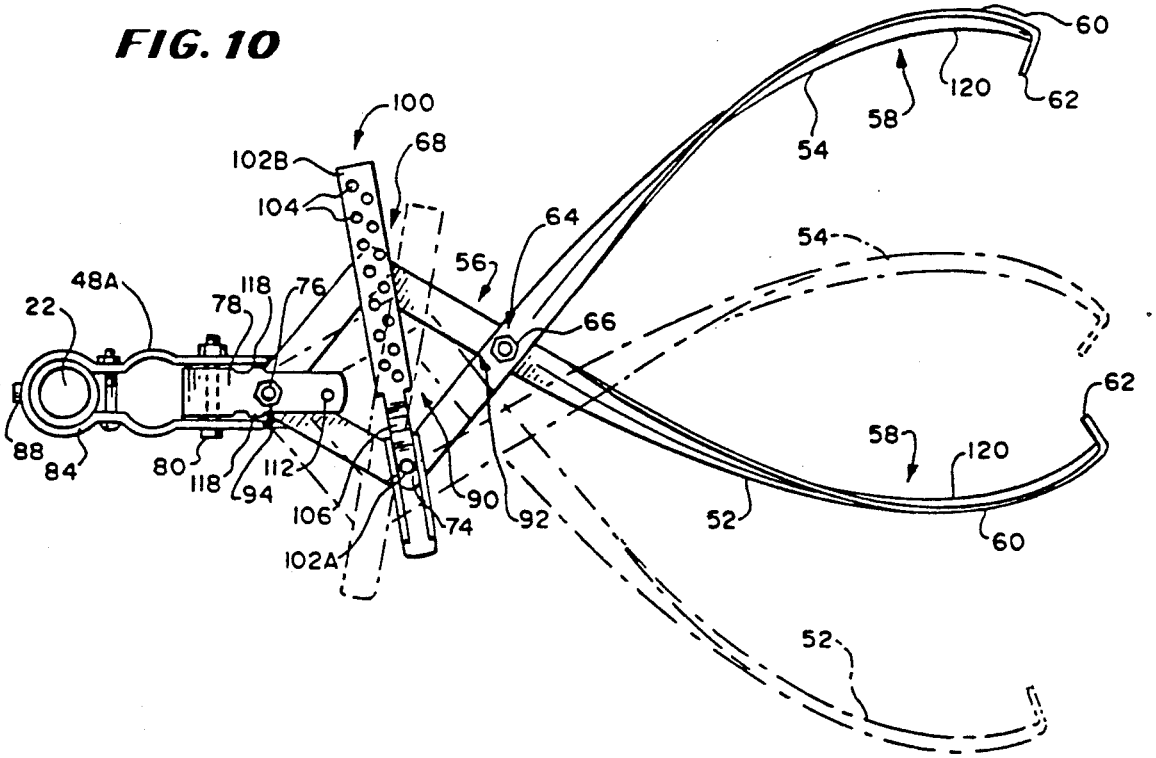
FIG. 10 is a top view of the gripping arms shown in FIG. 9 and further showing their capacity for movement horizontally from side to side relative to the frame.

The independent horizontal (side to side) and vertical (up and down) movements of the gripping arms 52 and 54 shown in FIGS. 9 and 10 lend great flexibility to the possible orientation of the gripping arms 52 and 54 relative to the frame 18. The side to side flexibility of the gripping arms 52 and 54 accommodates structures 12 (like a typical tree 14) that are not uniform along their vertical height. The up and down flexibility of the gripping arms 52 and 54 accommodates shifting of the ladder frame 18 vertically upon the structure 12 during use. The pivotally mounted lowermost standoff bracket 48B (on the bottom frame section 26) complements this flexibility.

The above described arrangement between the carriage bracket 78, the link bars 70 and 72, and the gripping arms 52 and 54 forms a "lazy-tongs" linkage 90 between the frame 18 and the outer end portions 58 of the gripping arms 52 and 54. The threaded bolt 66 pivotally joining the two gripping arms 52 and 54 forms the outer end 92 of the linkage 90. The threaded bolt 76 pivotally joining the two link bars 70 and 72 to the carriage bracket 78 forms the inner end 94 of the linkage 90. When one or more of the gripping arms 52 and 54 contact the tree 14, movement of the frame 18 relative to the tree 14 operates the lazy tongs linkage 90. This, in turn, operates the gripping arms 52 and 54.

Figure 11:
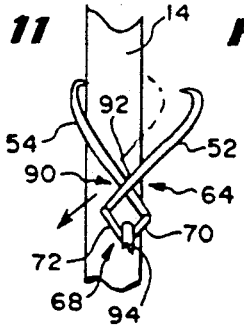
FIGS. 11 to 13 are schematic perspective views of the sequence of attaching and removing the ladder shown in FIG. 1 to and from tree structure.

In the attachment mode (as FIG. 11 shows), the user works the gripping arms 52 and 54 (via the lazy tongs linkage 90) by moving the frame section 22 with the gripping arms 52 and 54 opened a sufficient distance to receive the girth of the tree 14. First, the user opens the gripping arms 52 and 54 and rests them on the limit stop 82 of the standoff bracket 44A. The user then manipulates the frame section 22 from the ground toward the tree 14 to move at least one of the gripping edges 62 against the tree 14 (as FIG. 11 shows). Then, with at least one of the gripping edges 62 contacting the tree 14, the user moves the frame section 22 down to set the standoff brackets against the tree 14. In response to this user-applied force, the gripping arms 52 and 54 pivot upwardly from the limit surface 82. The lazy tongs linkage 90 also react by moving the outer and inner ends 92 and 94 of the linkage 90 apart to close the gripping arms 52 and 54. This action of the lazy tongs linkage 90 moves both gripping edges 62 into contact with the sides of the tree 14. In this way, the user hangs the upper frame section 22 onto the tree 14.

Once the upper frame section 22 is attached to the tree 14, the user can step upon a rung 20 of the ladder 16 to apply weight to the attached frame section 22. The applied weight will typically first pull the attached frame section 22 further downward relative to attached gripping arms 52 and 54, until the entire force of the applied weight is directly transmitted by the frame 22 to the lazy tongs linkage 90 (see FIG. 12). The attached gripping arms 52 and 54 further pivot (via the carriage bracket 78) to accommodate this further downward movement Once the force of the applied weight is directly transmitted to the lazy tongs linkage 90, the lazy tongs linkage 90 reacts by urging the inner and outer linkage ends 92 and 94 further apart. This, in turn, further urges the gripping arms 52 and 54 closer together, bringing both gripping edges 62 into more intimate contact with the sides of the tree 14. As the gripping arms 52 and 54 are continuously urged closed by the force of the applied weight, the bite of the gripping edges 62 into the tree 14 intensifies.

In this way, the attachment of the frame section 22 becomes stronger in direct proportion to the magnitude of the weight applied to the frame section 22. As long as the user's weight remains on the frame section 22, the lazy tongs linkage 90 secures the engagement of the frame to the tree 14.

Figure 13:
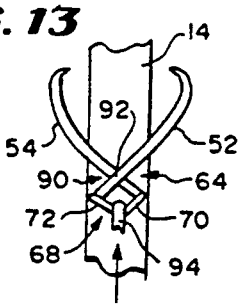

Once the user leaves the frame section 22, the force of the applied weight is removed from the lazy tongs linkage 90. The user can further relax the lazy tongs linkage 90 by standing on the ground and lifting the frame section 22 (as FIG. 13 shows). The attached gripping arms 52 and 54 pivot downward (via the carriage bracket 78) to accommodate this relative upward movement of the frame, until the lazy tongs linkage 90 abuts against the limit surface 82 on the standoff bracket 44A. Further upward force on the frame section 22 will be transmitted by the now vertically restrained lazy tongs linkage 90 to move the outer and inner ends 92 and 94 of the linkages 90 together, opening the gripping arms 52 and 54. The user can then easily pull the frame section 22 from the tree 14.

The preceding sections describe how a ladder 16 having a single section frame can be attached to the tree 14 for use and then detached from the tree 14 after use.

The gripping arms 52 and 54 can also be operated in the above described manner to assemble the multiple frame sections 22, 24 and 26 in place on the tree 14. Once the upper frame section 22 is initially attached to the tree 14 in the manner just described (as FIG. 11 shows), the user can join the middle frame section 24 to the upper frame section 22 from the ground, as also previously described. The user can then lift the now joined upper and middle frame sections 22 and 24 upwardly to open the gripping arms 52 and 54 (as just described and shown in FIG. 13) to move them as a unit farther up the tree 14. The joined upper and middle frame sections 22 and 24 can be attached back to the tree 14 as a unit by contacting the tree 14 with at least one gripping arm 52 or 54 and moving the joined sections 22 and 24 back into the tree 14, again closing the gripping arms 52 and 54 (as shown in FIG. 11). The bottom frame section 26 can next be joined from the ground to complete the assemblage.

In the illustrated and preferred embodiment, the bottom frame section 26 includes a tie off 96. Once the bottom frame section 26 is joined to the upper and lower frame sections 22 and 24, the entire lower portion of the assembled frame 18 can be secured to the tree 14 using the tie off 96 (as shown in FIG. 1). A cam lock mechanism 98 of the type shown in Skyba U.S. Pat. No. 4,716,630 secures the free end of the tie off 96.

Figure 12:
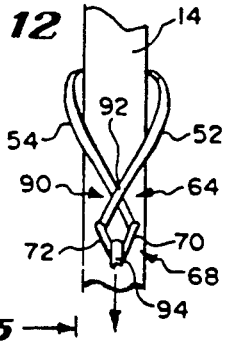

Once the entire frame 18 is assembled and the tie off 96 secured, the user is free to apply weight to the frame 18 to set the gripping arms 52 and 54 in their fully engaged position on the tree 14 (as described and shown in FIG. 12).

The ladder 16 can be disassembled and removed from the tree 14 using the reverse sequence of steps.

In the illustrated and preferred embodiment (see FIG. 14), the ladder 16 includes a mechanism 100 operable by the user to lock the gripping arms 52 and 54 in range of selected spaced apart, conditions. Once locked, the distance between the gripping arms 52 and 54 cannot be altered despite the application of external forces.

With the frame 18 attached to the tree 14 and the lazy tongs linkage 90 locked, the frame 18 cannot be removed from the tree 14. The locking mechanism 100 thus prevents inadvertent detachment of the frame 18 when in use. The locking mechanism 100 can also be padlocked to prevent theft of the frame 18, when left unattended on the tree 14.

Figure 14:
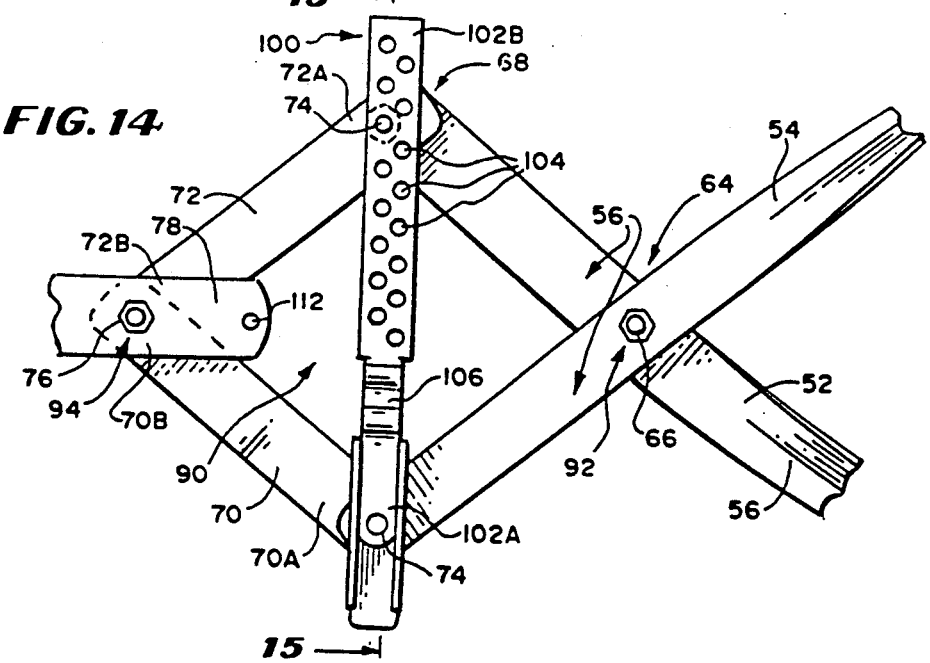
FIG. 14 is a top plan view of the locking mechanism associated with the gripping arms shown in FIGS. 7 and 8.

The locking mechanism 100 can be variously constructed. In the illustrated embodiment (as FIG. 14 shows), the locking mechanism 100 includes a locking bar 102 that is attached to the lazy tongs linkage 90 between its inner and outer ends 92 and 94. In its locked position (shown in solid lines in FIG. 10), the locking bar 102 extends across the length of the lazy tongs linkage 90 to prevent relative movement between its inner and outer ends 92 and 94.

Figure 15:
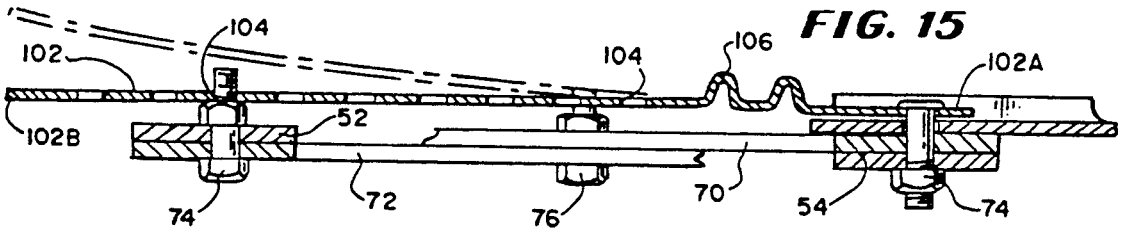
FIG. 15 is a side section view of the locking mechanism taken generally along line 15—15 in FIG. 14.

In the embodiment shown in FIG. 14, the locking bar 102 is attached at one end 102A to the same threaded bolt 74 that joins an end 70A of one link bar 70 to the inner end portion 56 of one of the gripping arms 54. The other end 102B of the locking bar 102 includes a series of locking apertures 104. The locking bar 102 is pivotally movable into the locked position by engaging an end of the bolt 74 that joins the link bar 72 to the gripping arm 52 (as FIGS. 14 and 15 show).

A resilient flex joint 106 located between the ends of the locking bar 102 (see FIG. 15) allows the user to resilient bend the locking bar 102 to engage and disengaged the bolt 74 with a selected one of the locking apertures 104. When engaged on the bolt, the flex joint 106 also biases the locking bar 102 toward its locked position.

The locking bar 102 includes an array of several locking apertures 104 so the user can selectively lock the lazy tongs linkage 90 at a multitude of gripping positions.

In the illustrated and preferred embodiment (see FIGS. 16 and 17), the carriage bracket 78 also includes first and second limit stops 108 and 110 to prevent over extension or under extension of the lazy tongs linkage 90, respectively.

Figure 17:
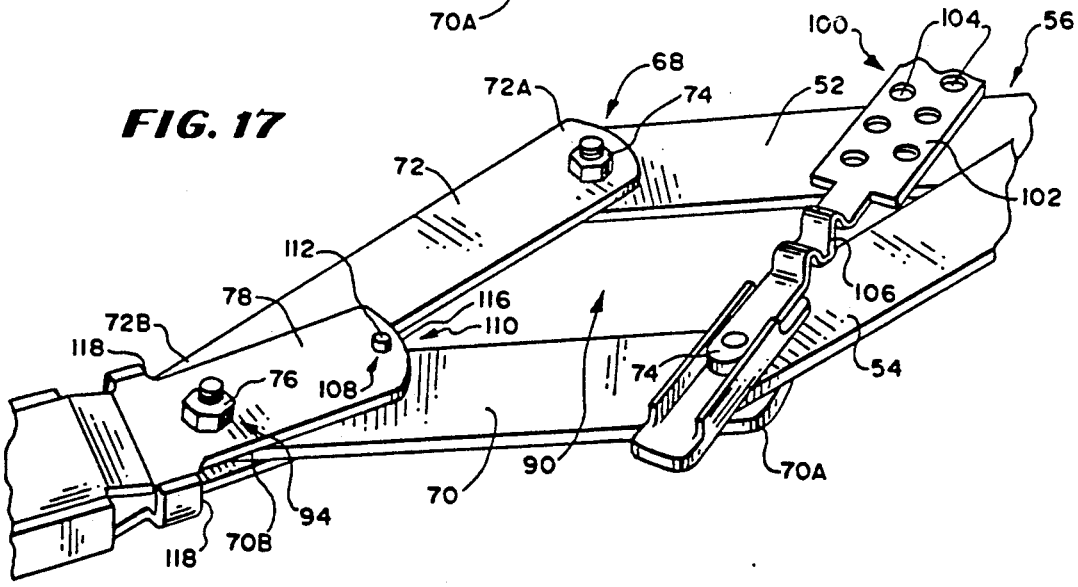
FIG. 17 is a view of the carriage bracket for the gripping arms shown in FIGS. 7 and 8, with gripping arms located in their fully closed position.

The limit stops 108 and 110 can be variously constructed. In the illustrated embodiment (as FIG. 17 shows) the first limit stop 108 comprises a vertical pin 112 that extends through the center front 114 of the carriage bracket 78. As the lazy tongs linkage 90 extends to move the inner and outer ends 92 and 94 of the linkage 90 apart, each link bar 70 and 72 will eventually abut against the pin 112.

The abutment prevents further extension of the lazy tongs linkage 90 beyond the position shown in FIG. 7 into an over extended and potentially interlocked position. The first limit stop pin 112 thereby defines a fully closed position to prevent damage to the gripping arms 52 and 54.

Figure 16:
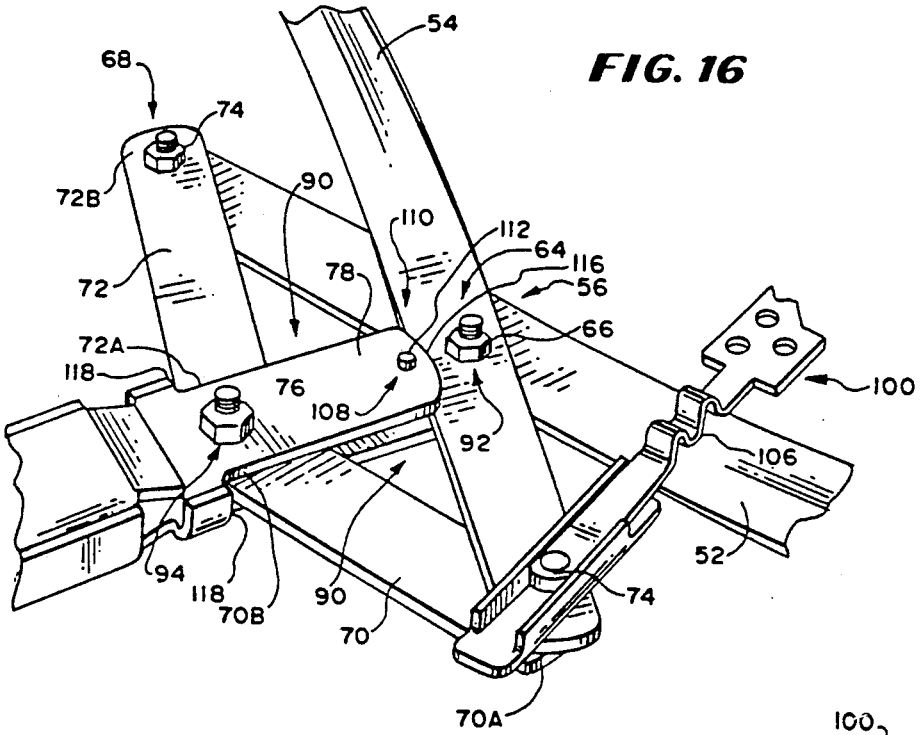
FIG. 16 is a view of the carriage bracket for the gripping arms shown in FIGS. 7 and 8, with the gripping arms located in their fully opened position.

As FIG. 16 shows, the center front edge 116 of the carriage bracket 78 forms a part of the second limit stop 110. As the lazy tongs linkage 90 contracts to move the inner and outer ends 92 and 94 of the linkage 90 together, the outer end 92 of the linkage 90 will eventually abut against the front edge 116 of the carriage bracket 78. This abutment prevents further contraction of the lazy tongs linkage 90 beyond the position shown in FIG. 8 into an fully collapsed and potentially interlocked position that could damage the linkage 90. The second limit stop edge 116 thereby defines a fully opened position of the gripping arms.

When the gripping arms 52 and 54 are in the fully opened position and resting against the limit surface 82 of the standoff bracket 44A, they are presented in a self-centered position for ready engagement with the tree 14.

The second limit stop 110 also includes a pair of shoulders 118 that extend from opposite sides of the carriage bracket 78. Should the center front edge 116 of the carriage bracket 78 fail for whatever reason to stop further contraction of the lazy tongs linkage 90, the link bars 70 and 72 will proceed into abutment against the shoulders 118. This second zone of abutment constitutes back up limit protection to assure that over contraction and binding of the lazy tongs linkage 90 will not occur.

Figure 18:
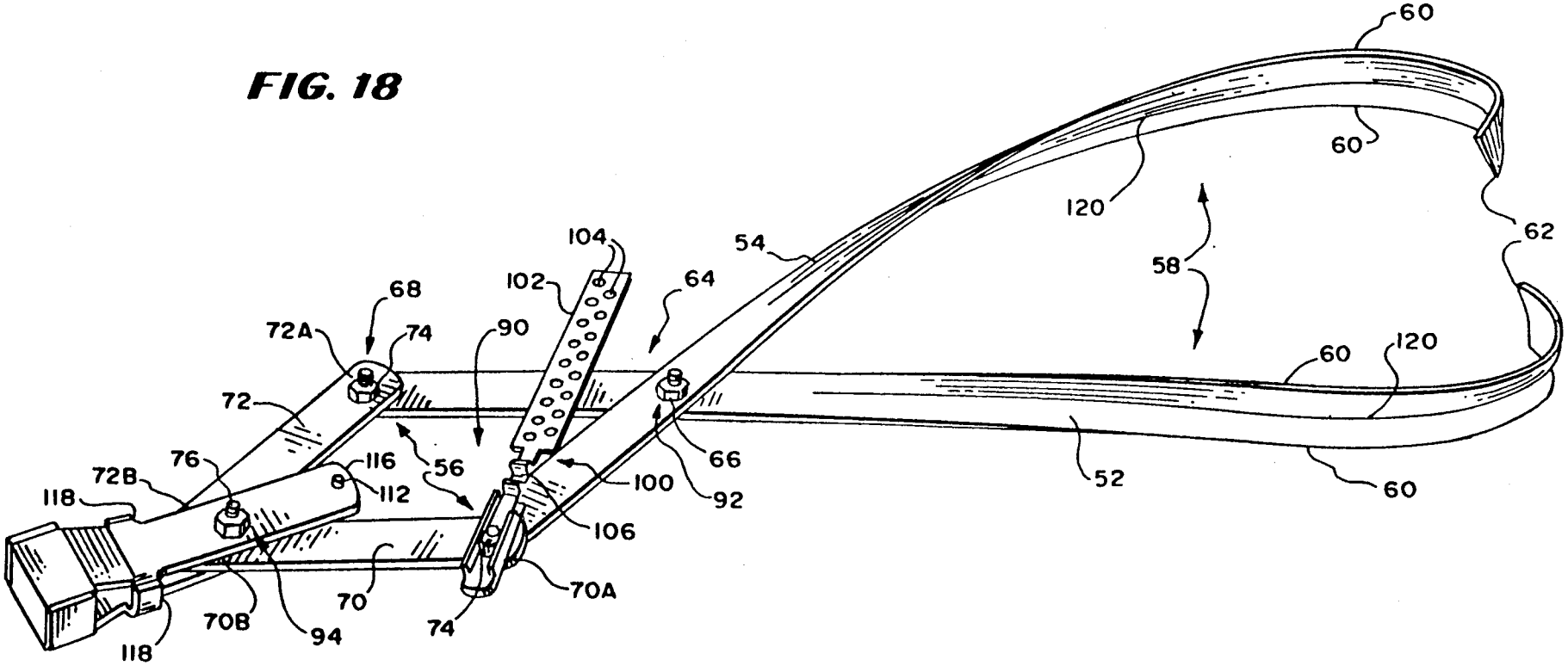
FIG. 18 is a perspective view of the particular details of construction of the gripping arms associated with the ladder shown in FIG. 1.

In the illustrated and preferred embodiment (as FIG. 18 best shows), each gripping arm 52 and 54 has a shape that, when viewed along the vertical axis of the tree 14 generally conforms to the outer periphery of the tree 14.

Furthermore (as FIG. 18 also best shows), each the gripping arms 52 and 54 is beveled across its vertical width into a generally V-shape configuration. In this configuration, the base 120 of the "V" generally faces the side of the tree 14, while the side edges 60 of the gripping arms 52 and 54 are face away from the tree 14. Because of the beveled configuration, the region 120 of the gripping arms 52 and 54 that runs adjacent to the exposed surface of the tree 14 presents a reduced surface area. This configuration minimizes contact between the side edges 60 or other large exposed surfaces of the gripping arms 52 and 54 and the surface of the tree 14. Without the beveled configuration, such exposed regions of the gripping arms 52 and 54 could easily become stuck or wedged against the tree 14 during use, particularly where the surface is rough or uneven, as is usually the case.

Also in the illustrated and preferred embodiment (still referring principally to FIG. 18), each gripping arm 52 and 54 is curved along its length (between inner and outer portions 56 and 58) in the direction of the ground. Thus, when viewed from the side, each gripping arm 52 and 54 is generally outwardly bowed or convex in shape, relative to the plane of the ground. This configuration distributes the forces applied to the gripping arms 52 and 54 to resist pulling the gripping edges horizontally out of the tree 14.

More particularly, when the weight of the user is transmitted by the lazy tongs linkage 90 to the gripping arms 52 and 54, the curved shape serves to distribute the applied forces downward generally along the vertical axis of the tree 14. The curved shape prevents the applied forces from dragging or pulling the gripping edges 62 out of the tree 14 across the vertical axis of the structure 12. Therefore, should slippage of the gripping arms 52 and 54 occur when weight is applied, the slippage will be directed vertically down the tree 14, and not horizontally out of the tree 14.

The curved shape also distributes the applied force uniformly along the entire length of the gripping arms 52 and 54. Thus, the curved shape prevents the applied force from unequally loading and bending the gripping arms 52 and 54, or otherwise exerting forces that would break or bind the gripping arms 52 and 54 or lazy tongs linkage 90.

The features and advantages of the invention are set forth in the following claims.

I claim:

1. An apparatus for supporting weight on an upright structure having opposite, generally vertical side edges, the apparatus comprising a frame having a weight bearing surface, first and second gripping arms carried on the frame, each having an outer end portion that extends beyond the frame, each outer end portion including a gripping edge, first linkage means joining the gripping arms for moving the outer end portions away from and toward each other to thereby open and close the distance between the gripping edges, and second linkage means that joins the first linkage means to the frame and serves to open and close the gripping arms in response to forces applied to the frame relative to the structure, the second linkage means being operative for attaching the frame to the structure when the gripping arms are opened a sufficient distance to receive the structure and in contact with at least one side edge of the received structure, by serving, in response to a subsequent force that moves the frame into contact with the structure, to close the gripping arms a sufficient distance to bring both gripping edges into contact with the side edges of the structure, the second linkage means also being operative for supporting weight on the frame when attached to the structure, by serving, in response to the downward force of the weight applied to the weight bearing surface of the frame, to urge the gripping arms continuously toward each other to thereby continuously secure an engagement of both the gripping edges on the structure as weight is applied, and the second linkage means being further operative for detaching the frame from the structure when weight ceases to be applied to the weight bearing surface of the frame, by serving, in response to a force that moves the frame in a direction away from the ground, to open the gripping arms a sufficient distance to bring both gripping edges out of contact with structure.

2. An apparatus according to claim 1
and further including locking means for selectively preventing movement of the gripping arms.

3. An apparatus according to claim 1
and further including first pivot means for moving the gripping arms in an up and down direction along the vertical axis of the frame.

4. An apparatus according to claim 3
wherein the first pivot means includes first limit means for preventing downward movement of the gripping arms beyond a predetermined position along the vertical axis of the frame.

5. An apparatus according to claim 3
and further including second pivot means for moving the gripping arms in a side to side direction across the vertical axis of the frame.

6. An apparatus according to claim 1
and further including second pivot means for moving the gripping arms in a side to side direction across the vertical axis of the frame.

7. An apparatus according to claim 6
wherein the second pivot means includes second limiting means for preventing side to side movement of the gripping arms beyond a predetermined range of positions.

8. An apparatus according to claim 1
wherein the first linkage means includes first stop means for limiting movement of the gripping arms away from each other beyond a prescribed fully opened position.

9. An apparatus according to claim 8
wherein the first linkage means includes second stop means for limiting movement of the gripping arms toward each other beyond a prescribed fully closed position 10. An apparatus according to claim 1
wherein the frame includes an upper frame section, a lower frame section, and means for releasably joining the upper and lower frame sections together in a vertically stacked relationship along the structure, and
wherein the gripping arms are attached to the upper frame section.

11. An apparatus according to claim 10
wherein the upper frame section includes standoff means for holding the upper frame section a predetermined distance away from the structure when the gripping arms attach the upper frame section to the structure.

12. An apparatus according to claim 11
wherein the second linkage means attaches the first linkage means to the upper frame section adjacent the standoff means.

13. An apparatus according to claim 11
wherein the lower frame section includes second standoff means for holding the lower frame section a predetermined distance away from the structure when the upper and lower frame sections are joined together and the gripping arms attach the upper frame section to the structure.

14. An apparatus according to claim 13
wherein the second standoff means is pivotally movable up and down along the vertical axis of the lower frame section to accommodate movement of the lower frame section along the vertical axis during use.

15. An apparatus according to claim 1
wherein the frame includes at least two frame sections and means for releasably joining the frame sections together in a vertically stacked relationship along the structure,
wherein the gripping arms are attached to the frame section that, in use, is the topmost frame section, and
wherein each frame section includes standoff means for holding the frame section a predetermined distance away from the structure when attached to the structure, the standoff means also being operative for attaching the frame sections together in a generally horizontally stacked relationship for transport prior to use.

16. An apparatus according to claim 1
wherein the frame includes standoff means for holding the frame a predetermined distance away from the structure when the gripping arms attach the frame to the structure.

17. An apparatus according to claim 16
wherein the standoff means includes a first standoff means near the top of the frame and second standoff means near the bottom of the frame, and wherein the second linkage means attaches the first linkage means to the frame adjacent the first standoff means.

18. An apparatus according to claim 17
wherein the second standoff means pivots up and down along the vertical axis of the frame to accommodate movement of the frame along the vertical axis during use.

19. An apparatus according to claim 1
wherein at least one of the gripping arms is curved along lengthwise in the direction of the ground for directing the force applied to the gripping arm during use in a path that generally extends along the vertical axis of the structure.

20. An apparatus according to claim 1
wherein the outer portions of the gripping arms each include opposite side edges, and
wherein the side edges of at least one of the gripping arms is beveled across its width into a generally V-shape configuration, with the base of the V generally facing the structure and the side edges of the gripping arm facing away from the structure.

21. An apparatus according to claim 1
wherein the frame includes a series of weight bearing surfaces spaced along the vertical axis of the frame and comprising steps for climbing the 22. A gripping arm assembly for supporting weight on an upright structure having opposite, generally vertical side edges, the assembly comprising
first and second gripping arms carried on a frame and pivoted together in scissors fashion, each arm having an outer end portion that extends beyond the frame, each outer end portion including an inwardly facing sharpened gripping edge adapted to bite into the surface of the upright structure, and
said gripping arms are curved lengthwise from the gripping arms to the frame for transferring a downward force applied to the gripping arm during use into a plane generally parallel to the vertical axis of an upright structure to which the assembly is attached.

23. An apparatus according to claim 22
wherein the outer portions of the gripping arms each include opposite side edges, and wherein the side edges of at least one of the gripping arms is beveled across its width into a generally V-shaped configuration, with the base of the V generally facing the structure and the side edges of the gripping arm facing away from the structure.

24. A gripping arm assembly for supporting weight on an upright structure having opposite, generally vertical side edges, the assembly comprising first and second gripping arms carried on the frame, each having an outer end portion that extends beyond the frame, each outer end portion including a gripping edge, the outer portions of the gripping arms also each including opposite side edges, and the side edges of at least one of the gripping arms is beveled across its width into a generally V-shape configuration, with the base of the V generally facing side of the structure being engaged by the gripping edge and the side edges of the gripping arm facing away from the structure.

25. A gripping arm assembly according to claim 22 or 24 and further including first linkage means joining the gripping arms for moving the outer end portions away from and toward each other to thereby open and close the distance between the gripping edges.

26. A gripping arm assembly according to claim 25 and further including second linkage means for remotely operating the first linkage means.

* * * * *

UNITED STATES PATENT AND TRADEMARK OFFICE

CERTIFICATE OF CORRECTION

PATENT NO. : 5,109,954

DATED : May 5, 1992

INVENTOR(S) : Helmut K. Syba

It is certified that error appears in the above—identified patent and that said Letters Patent is hereby corrected as shown below:

Column 14, line 50:

After "climbing the" insert --- frame. ---.

Column 15, line 3:

Delete "V-shaped" and insert --- V-shape ---.

Signed and Sealed this

Thirty-first Day of August, 1993

Bruce Lehman

*Attest:*

BRUCE LEHMAN

*Attesting Officer*

*Commissioner of Patents and Trademarks*